US007748369B2

(12) United States Patent
Chee

(10) Patent No.: US 7,748,369 B2
(45) Date of Patent: Jul. 6, 2010

(54) LAUNCHING APPARATUS AND ASSEMBLY

(76) Inventor: Tyson Chee, 255 N. Forest St., Apt 300, Bellingham, WA (US) 98225

( * ) Notice: Subject to any disclaimer, the term of this patent is extended or adjusted under 35 U.S.C. 154(b) by 571 days.

(21) Appl. No.: 11/549,922

(22) Filed: Oct. 16, 2006

(65) Prior Publication Data

US 2008/0087263 A1 Apr. 17, 2008

(51) Int. Cl.
*F41B 3/02* (2006.01)

(52) U.S. Cl. ..... 124/20.3; 124/20.1; 473/578

(58) Field of Classification Search ..... 124/16, 124/17, 20.1, 20.2, 20.3, 23.1; 473/578
See application file for complete search history.

(56) References Cited

U.S. PATENT DOCUMENTS

| | | | | | |
|---|---|---|---|---|---|
| 1,572,270 | A | * | 2/1926 | Dwyer | 446/64 |
| 2,807,254 | A | | 9/1957 | Stribling | |
| 3,085,560 | A | * | 4/1963 | Peters | 124/23.1 |
| 3,749,075 | A | | 7/1973 | Saunders | |
| 3,834,368 | A | | 9/1974 | Geiger | |
| 3,875,923 | A | | 4/1975 | Horel | |
| 3,949,729 | A | * | 4/1976 | Pfotenhauer | 124/20.3 |
| 3,967,823 | A | | 7/1976 | Yount | |
| 4,073,328 | A | * | 2/1978 | Franklin | 206/315.11 |
| 4,250,861 | A | | 2/1981 | Ellenburg | |
| 4,802,677 | A | * | 2/1989 | Homan | 473/578 |
| 4,877,007 | A | | 10/1989 | Olson | |
| 4,922,884 | A | * | 5/1990 | Ford | 124/20.1 |
| 5,247,920 | A | * | 9/1993 | Harbin | 124/20.1 |
| 5,282,453 | A | * | 2/1994 | Chia | 124/20.1 |
| 5,501,207 | A | | 3/1996 | Black | |
| 5,619,978 | A | | 4/1997 | Flournoy | |
| 5,632,262 | A | | 5/1997 | Hanson | |
| 6,247,990 | B1 | * | 6/2001 | Moorhouse | 446/64 |
| 6,500,042 | B1 | * | 12/2002 | LaPointe | 446/64 |

* cited by examiner

*Primary Examiner*—John Ricci
(74) *Attorney, Agent, or Firm*—Jellett Law PS

(57) ABSTRACT

A launching apparatus for shooting a series of bolts in rapid-fire succession. The apparatus has an arcuate frame which is arranged along a longitudinal medial section with a transversely aligned upper section and a transversely aligned lower section. The midpoint of the arcuate frame has a grip portion for holding onto the launching apparatus. The frame also has an elastic launching band which is held tightly between an upper connector and a lower connector. A forearm brace extends perpendicular to the arcuate frame. The arcuate frame is held within a launching plane and the forearm being secured to the longitudinal medial section and aligned parallel to the user's forearm. The forearm brace resists an overturning moment applied from the elastic band about the longitudinal medial section of the arcuate frame. The brace keeps the arcuate frame in its launching plane. The bolt is configured for rapid-fire launch, and is arranged as a cylindrical shaft. The shaft has a fore end with a head portion, a first firing hook and a second firing hook arranged equidistant from one another and spaced circumferentially around the cylindrical shaft. The bolt also has at the aft end, a first fin which is radially extending from the shaft, and a second fin radially extending from the shaft. A third fin also radially extends from the cylindrical shaft; the first fin, second fin and third fins are spaced circumferentially equidistant apart from one another about the shaft to provide aerodynamic alignment during flight.

19 Claims, 6 Drawing Sheets

LAUNCHING APPARATUS AND ASSEMBLY

BACKGROUND

U.S. Pat. No. 5,632,262 (Hanson) discloses a compound slingshot, using a shortened pair of resilient bow limbs, which are horizontally mounted to a rigid center body. This center rigid body is essentially the rigid support shaft of the compound slingshot. It is divided into an upper section and a lower section. The upper section has the barrel or hole which the shaft exits through. Also, the bow limbs are rigidly connected to the upper section of the support shaft providing the desired rotational resistance. The bottom or lower section of the shaft body is the handgrip and a forearm brace. This compound is operated in an upright position where the bow limbs extend horizontally parallel with the plane of the earth. The firing mechanism includes a string which is attached to the cantilevered ends of the bow limbs. Referring to column three at line 63, a drawstring is essential attached at one end to the left compound pulley where it then passes through the left resilient bow limb and extends laterally down the horizontal length of the compound slingshot after passing underneath the drawstring retainer rod, which is essentially attached to the lateral surface of the body. The drawstring then passes through the right resilient bow limb when it engages the right compound pulley and encircles the pulley outside edge in 180 degree fashion to a point on the edge of the right compound pulley. The drawstring then extends back down the horizontal length of the body where it engages the inward edge of the left compound pulley. It again encircles the left pulley in 180 degree fashion passing underneath the drawstring retainer rod before passing through the right resilient bow limb, finally being attached to the right compound pulley. An ammunition pouch is mounted centrally between the two sides of the double separated string portion, which creates a pouch for the ammunition to be loaded within.

In the summary of the invention section, col. 2 around line 17, "the primary objective . . . is to provide a method of increasing a projectiles velocity from a handheld and forearm braced hunting or target shooting slingshot." Furthermore at line 36, "this configuration is compact . . . and combines . . . a compound bow with . . . a crossbow. Additionally, the present invention is designed to use round, steel shot as ammunition."

U.S. Pat. No. 5,619,978 (Flournoy) discloses a slingshot which has as rigid frame and a projectile launching area secured to a forearm support. The projecting launching area is made of an elongated cylindrical shaft in the current embodiment which is attached at the forward portion to a fork made of tubes. A cross member is secured to the rear end of the cylindrical shaft and includes a terminal end which has a handgrip. The forearm support member is asymmetrically offset from the centerline of the cylindrical shaft providing for example the left hand to act as the supporting forearm member and the right hand to act as the tensioning force keeping the projectile attached to the string reasonably in the center of the fork to provide for launching.

In the summary of the invention section, col. 1 around line 32, "it is a principle object of the invention to provide a slingshot which may be aimed in a manner similar to that of a rifle or shotgun by sighting directly along the longitudinal axis of one of it's members so the projectiles may be thrown there from with great velocity, accuracy and ease." Furthermore at line 52, "briefly . . . this invention achieves the intended objects . . . including a first elongated member with a forward end and a rearward end. A fork adapted for attachment of a pair of elastomerics tubes secured to the forward end . . . a crossmember secured to the rearward end of the first elongated member has a terminal and remote there from and defining a handgrip."

U.S. Pat. No. 5,501,207 (Black) discloses an arm brace slingshot formed by a U-shaped member having elongated legs adapted to extend along opposite sides of a forearm with the bight portion disposed forwardly of the user's hand when gripping a handle transversely extending between the legs. Inverted L-shaped posts are mounted on the respective forward and end portions of each leg adjacent to the bight portion have their foot portions projecting generally rearward and parallel to the elongated legs and angled inward relative to the longitudinal axis of the frame legs for better sighting alignment of the missile pocket of a sling connected with the post foot portions which transfer the strain of stretching the sling to the forearm of the user.

In the background of the invention section, col. 1 around line 3, "this invention relates to slingshots and more particularly to a hand and wrist strain releasing slingshot." Furthermore in the summary of the invention section, column 2 around line 27, "the principle objects of this invention are: to provide a balanced unit formed by parallel frame rods joined at one end by a U-shaped bite portion; a handgrip adjacent to the bite portion; arm saddle strap securing the rods to the user's forearm which counters the stress or pull of a tubular sling and provides stability for true and accurate shooting in which the sling is attached . . . "

U.S. Pat. No. 4,877,007 (Olson) discloses a sling bow for launching arrows, which has a handle connected to a pair of sling posts with a twin sling attached. The sling arms are made of elastic material which can be stretched and released to prepare an arrow between sling posts. A movable arrow rest connected between the sling arms near the sling posts supports the forward end of the arrow when the sling is stretched.

In the disclosure of the invention section, col. 1 around line 51, "in the sling bow of this invention the arrow rest extends between and is supported by the arms of the sling. When the sling is stretched the rest automatically rises to a position where it can support a forward region of an arrow. When the sling is released and relaxes, the rest drops out of the way of the arrow so as not to interfere with its flight."

U.S. Pat. No. 4,250,861 (Ellenburg) discloses a foldable wrist brace slingshot which has a yoke, handgrip and elastic members connected to the yoke. A wrist brace is connected and detachable to the handgrip at the base of the grip. The wrist brace has longitudinal support members which angle obtusely from the handgrip which make for extra room to receive the wrist between the members. The wrist brace can be folded down and locked into place over a cam surface which has grooves allowing for the longitudinal members of the wrist brace to spread slightly and pass over the cam surfaces to lock the wrist brace into place for the shooting position.

In the summary of the invention section, col. 1 around line 46, "these and other objects of the invention are obtained by a folding slingshot comprising a yoke having a handgrip, elastic members connected to the yoke, wrist brace means frictionally, detachably and pivotally mounted to the handgrip near the base, the wrist brace comprising a pair of longitudinally aligned members diverging rearwardly from the handgrip spaced apart to receive the wrist between an end member integral row with said longitudinal members engageable with the user's wrist . . .

U.S. Pat. No. 3,967,823 (Yount) discloses a target and separable target markers for a dart, where the dart game provides the ability to hit or impact a target with a plurality of separate darts which each have a target marker separately mounted on them. The targets and target markers each cooperatively adapt to retain the target marker onto the target at the point of impact while the dart separates after hitting the target.

In col. 1 around line 7, "the principle objects of the present invention are: to provide a dart game and dart having a separable target marker to permit marking a hit or impact point on the target; . . . "

U.S. Pat. No. 3,918,427 (Turner) discloses a slingshot with the fork arranged forward of the handgrip which increases the distance through which the elastic string or member of the slingshot can be drawn back increasing the force and propelling missiles through the fork of the slingshot. Missiles or bolts in this particular concept having a hook at the front end for engaging the elastic string and have enlarged flattened tail fins with finger holes in them which act as the triggering mechanism. The tailfin is aerodynamically tapered with fins of some sort to stabilize the bolt in flight. Sighting along the shaft of the bolt significantly increases the accuracy of the slingshot and makes it possible to reliably hit game at respectable hunting ranges.

In the summary of the invention section around line 12, "this invention provides a novel slingshot and a novel slingshot missile capable of killing small and large game. The slingshot has a fork supported in a position forward of the handgrip to increase the distance through which the elastic of the slingshot can be drawn back, increasing the force applied to the missile. The missile is a bolt having a hook at its front end for engaging the elastic means having an enlarged flattened tailfin with finger holes therein. A broadhead can be attached to the front end of the bolt and shot from the slingshot with sufficient velocity to kill small or large game at reasonable hunting regions. . . . "the slingshot has an arm which is attached to the top of the handgrip and extends forwardly to the fork and rearwardly to a forearm brace. Accuracy is provided by cocking the fork at an angle to the axis of the arm at a central line perpendicular to the line between the attachment points of the elastic to the fork as directed toward the eyes of the user . . . "

U.S. Pat. No. 3,875,923 (Horel) discloses a slingshot with an arm brace and range indicating shooting distances. This is again a standard slingshot with an elongated elastic member and the slingshot has an elongated arm to provide for large projectile forces.

U.S. Pat. No. 3,865,094 (Sweeney) discloses an arm braced and stabilized slingshot which has an upright handle and a fork for attachment of elastic bands, a single rod which is releasably engaged to the upright and adapted to extend along the lower side of the user's forearm, and can be slidably attached and engaged to the user's forearm transferring forces from the wrist of the user to the upper forearm.

Referring to col. 1 around line 15, "a principle object of the present invention is to provide a slingshot of simple construction, easy to assemble and disassemble, easy to operate and which is effective in providing steadiness, accuracy, and comfort at great range.

U.S. Pat. No. 3,834,368 (Geiger) discloses an archery bow with a slingshot combination which has a construction with sections cantilevered to define a projectile opening between the two cantilevered sections. The opening allows unrestricted vision where the user can employ a binocular sighting to follow the flight of the arrows. The opening allows the projectile to have stabilizer sections which will not be impeded by standard bow shaft construction. The bow allows the bow string to move in a plane offset from the user's forearm and prevents slapping, scraping and injury. A slingshot projectile propelling device is attached to the cantilevered sections. This is in addition to the bow arms. The slingshot elastic member extends transversely between the cantilevered sections, thus having a string distance limited to the opening. The elastic string member for the slingshot is not elongated and tensioned as your composite bow sling is provided, which has the medial U-shaped shaft of the bow allowing for increased projectile force.

As seen in col. 1 around line 4, "the invention is to provide a bow and arrow that does not slide the arrow along or in close proximity of the bow as the arrow is discharged . . . ". Further at line 11, "also the arrow is so constructed to set the straddle of the bow string to a point that is forward past the arrow's center of gravity. The arrow is constructed with rigid fingers which also double as fins." Further at line 30, "a third object of this invention is to provide the choice of having a bow and arrow combined with a slingshot so either one can be used at will or either one used alone. The elastic string of the slingshot can also be used to launch toy gliders, airplanes etc."

U.S. Pat. No. 3,749,075 (Saunders) discloses a slingshot with connection for a projectile propelling an elastic member. This is a handheld slingshot with reversed hooked forearms for avoiding extreme flexure of the slingshot fork arms by sweeping the fork arms towards the rear.

As seen in col. 1 around line 7, "it is a principle feature of the invention that it obviates the destructive and abrasive wear suffered by the elastic tubes upon release and subsequent fold over during recoil of the tubes after distention and release of the elastic tubes in use of the slingshot."

U.S. Pat. No. 2,807,254 (Stribling) discloses a slingshot which is designed to be used with the user's hand gripping the handle placed in a horizontal arrangement underneath the U-shaped frame which has hooks which are curved upwardly, extending rearward with knobs at the upper end which provide for the securing of the sling, which is comprised of a pair of elastic tubes. Positioned within the middle of the elastic tubes is a leather missile engaging pocket. This is a standard slingshot construction which does not show any configuration similar to your concept using the natural properties of a bow construction.

DESCRIPTION OF THE EMBODIMENTS

Generally speaking, the present embodiment incorporates design and functions of a slingshot in combination with a bow-type construction and enables the user to provide sequential, rapid-fire shots of a plurality of existing bolts held by the user. The bolts are equipped with a series of firing hooks which are distributed about the outer face of the bolt and enable the user, while maintaining the bolts between the user's finger digits to fire the bolts quickly from between for example the index finger and the middle finger, the middle finger and the ring finger, or the ring finger and the small finger. With the combination of the quick launching firing bolts and the launching apparatus (to be described below), the user can rapidly fire at least three bolts in succession from the launching apparatus.

A discussion of the launching apparatus and its various characteristics and alternative embodiments will now be provided. A brief discussion of the structure and orientation of the launching apparatus will be provided. A discussion of the frame, the firing band, and the arm brace will be provided with varying embodiments. Further discussion of the arrangement of the launching apparatus to maintain a launching plane perpendicular to the forearm brace 34, as seen in FIG. 1, will also be provided.

The current main embodiments of the launching apparatus include the arcuate frame 12 which is arranged within a launching plane defined by a longitudinal axis 14 and a transverse axis 16. Perpendicular to this launching plane is the forearm brace 34 which in this particular embodiment includes an upper forearm member and a lower forearm member or section.

Figure 1:
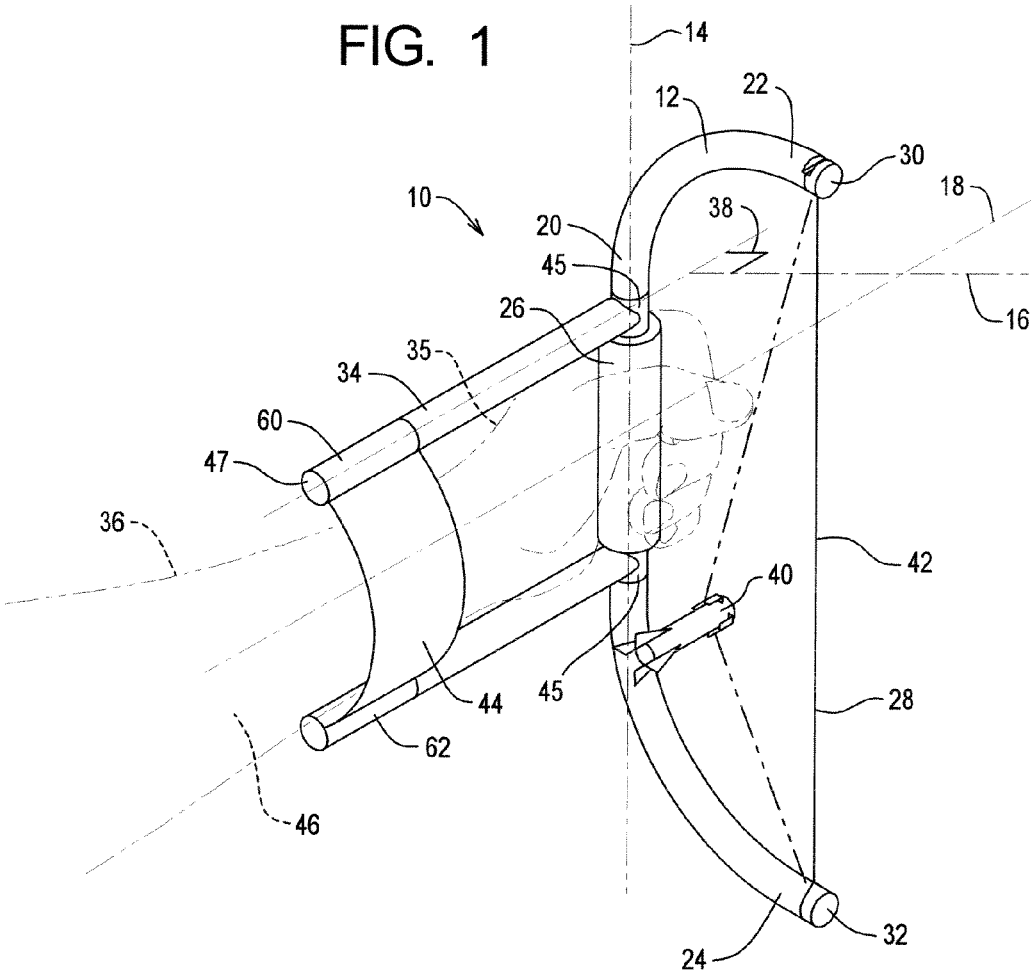
FIG. 1 is a perspective view of the launching apparatus.

Referring to FIG. 1, the launching apparatus 10 has an arcuate frame 12 which is divided into a longitudinal medial section 20 located at the midpoint of the frame and transforms into a transversely aligned upper section 22 and a transversely aligned lower section 24 which both include or make up the top and bottom portions of the arcuate frame 12.

The arcuate frame is constructed of in one embodiment, a wood material, but other types of materials can be used including a plastic-type material, metallic material, carbon fiber material, or other suitable alloys.

Figure 2:
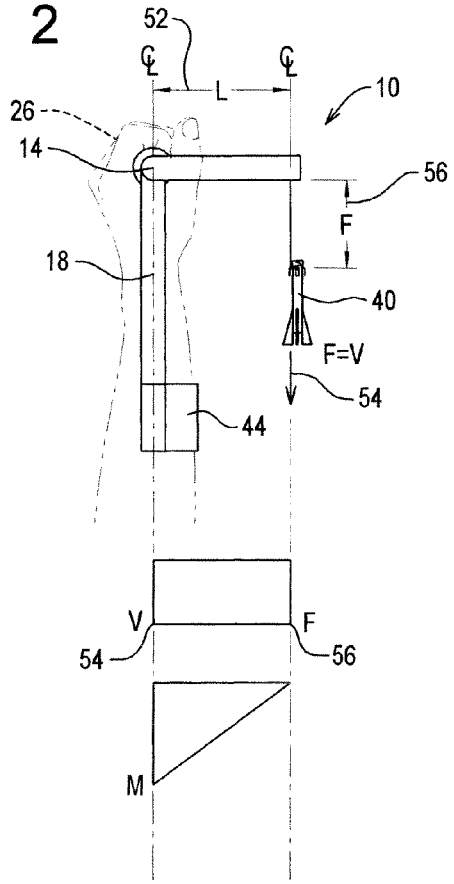
FIG. 2 is a schematic diagram of the launching apparatus.

Within the launching plane, the arcuate frame 12 is arranged so that the elastic launching band 20 is displaced a transverse distance 52 as seen in FIG. 2, so that the launching of the bolt 40 is substantially unimpeded by the frame 12 as well as having the user's forearm 36 being positioned to the transverse side of the launching plane to avoid potential injury.

Extending laterally from the longitudinal medial section 20 and the longitudinal axis 14, is a forearm brace 34 which runs parallel to the user's forearm 36. The user's forearm 36 is arranged about a forearm central axis 18. The forearm and hand 35 hold onto the launching apparatus 10 at the grip location 26 configured to accept the user's hand 35.

A discussion of the forces acting on the launching apparatus will now be provided. In the present embodiment as seen in FIG. 1 as well as FIG. 2, the arcuate frame 12 is held within the launching plane at a right angle 38 perpendicular to the forearm central axis 18. The forearm brace 34 provides leveraging resistance for the arcuate frame 12 during launch of the bolt 40 as further discussed below. Referring to FIG. 2, the user grips the launching apparatus 10 at the grip location 26 and the second hand of the user is used to hold the bolt 40 and provide a launching force 54 where the user by attaching the bolt 40 to the elastic launching band 28 at the intermediate catch portion 42 of the launching band applies the launching force 54 against the band 28. The intermediate catch 42 is the location where the bolt 40 (discussed in more detail below) hooks onto the elastic launching band 28 for releasable firing.

The launching force 54 applied by the user will reach the maximum elastic band capacity 56 if the user pulls the bolt 40 along with the hooked elastic band 28 to its nearly inelastic capacity, thus providing a maximum elastic band launching force 54.

As indicated above, the elastic band 28 is located a transverse launching distance 52 away from the longitudinal axis 14 of the main portion of the arcuate frame 12. The launching force 54 combined with the transverse distance or launch moment arm 52 creates a launching moment (M) about the longitudinal axis 14 of the longitudinal medial section 20.

To maintain the arcuate frame's planar orientation within the launching plane, the forearm brace 34 is rigidly connected to the longitudinal medial section 21 of the arcuate frame 12 as seen in FIG. 1-2. Rigid connection is provided either in a permanent type of connection or can be provided on a temporary type connection such as through the use of a quick release mechanism. In this current embodiment, clockwise positive moment about the longitudinal axis 14 is resisted by the forearm brace 34 because the forearm seat 44 rigidly attached at the unconnected end or distal end of the forearm brace 34 presses against the inside face 46 of the user's forearm 36 and resists the rotational launching moment arm provided by the launching force 54 in combination with the transverse distance 52. A user thus can rely on a securely aligned plane and does not have to maintain the constant gripping force on the grip portion 26 of the longitudinal medial section 20, thus giving the user a greater level of accuracy during firing.

The forearm brace has in the current embodiment (as seen in FIG. 1), the upper laterally aligned member 60 and the lower laterally aligned member 62, which run parallel with the user's forearm central axis 18. The forearm brace 34 must be held in place along a longitudinal axis 14 by leveraging against the inside face of the user's arm 46. To accomplish this leverage resistance a forearm seat 44 is provided which in one embodiment can be a rigid type of semi-cylindrical plastic construction arranged to fit into the outside circumferential face of the user's forearm or it can be a soft pliable type of material such as a fabric or foam pad-type material.

The longitudinal transverse plane or in other words the launching plane, held at a predetermined launching angle 38 to the forearm central axis 18, can be adjusted to additional launching plane angles to the forearm central axis 18 by an adjustment coupling mechanism about the longitudinal medial section 20 at the intersection of the forearm brace 34 with the longitudinal medial section 20.

Depending on the distance desired for launching as well as the force desired for impact of the bolt against the target, the elastic launching band, as seen in FIG. 1, can be provided in varying embodiments to be utilized for launching the bolt 40.

Figure 3:
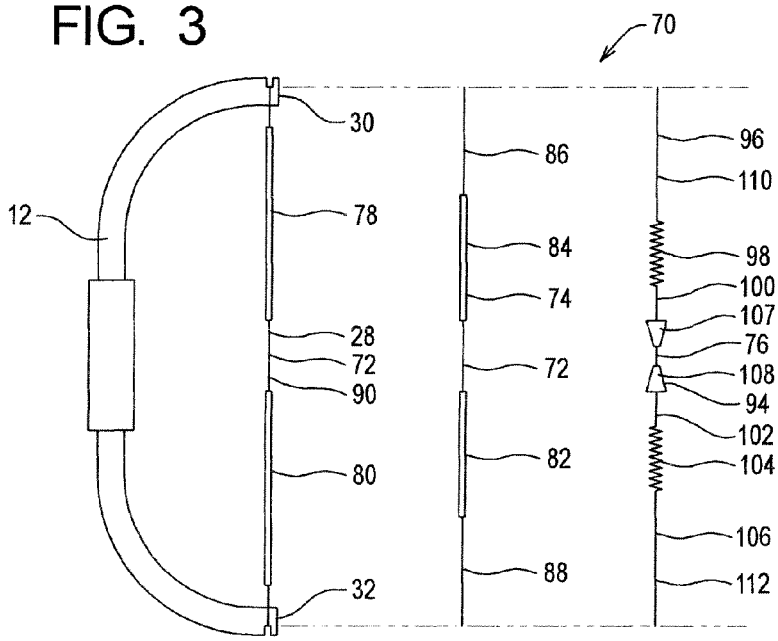
FIG. 3 is an elevational view of the elastic band embodiments.

Referring to FIG. 3, the arcuate frame 12 is shown with currently 4 embodiments for the launching band. The first embodiment as seen previously in FIG. 1 is essentially an elastic band 28 which is constructed of a rubber-type material and is stretched taut between the upper connector 30 and the lower connector 32 leaving enough elastic spring capacity for the pullback of the bolts 40 during the launching from the intermediate catch location 42. As seen in FIG. 3, the elastic band embodiments 70 further include a three part band assembly 72, which has a first elastic band 78 and a second elastic band 80, both connected respectively to the upper and lower connectors of the arcuate frame 12. The first band 78 and the second band 80 connect to the inelastic hook catch 72. The inelastic hook catch 72 can be, for example, a piece of rope or other type of fiber material which has flexible capacity to bend but which has little or no elasticity.

A third embodiment of the band is a five-part band 74 which has a first inelastic elastic band member connected to the upper connector 30 and a second inelastic band member 88 which connects to the lower connector 32. A first elastic band member 84 and a second elastic band member 82 both provide the spring launching force 54 for the firing of the bolts 40. In this particular embodiment the first band member 84 and the second band member 82 are constructed of surgical tubing provided in varying diameters for increased or decreased launch capacity.

A fourth alternative embodiment provided is a seven-part launching band 76 which utilizes coiled springs for the launching force 54 (FIG. 2). A first coiled spring 98 and a second coiled spring 104 provided. Attached between the upper connector 30 and the first coiled spring 98 is an inelastic connector 96 which in this particular embodiment can be a rope-type of material. In between the lower portion of the first coiled spring 98 and the intermediate tapered catch portion 94 of this particular embodiment, is a second inelastic band connector 100. Likewise, the lower portion of the seven-part band includes a first lower inelastic band 106 which connects the second coiled spring 104 to the lower connector 32. The coiled spring 104 also has a second lower inelastic band 102 which connects the coiled spring to the intermediate tapered catch portion 94.

This intermediate tapered catch portion 94 is essentially a V-shaped tapered section with an upper tapered member 106 and a lower tapered member 108 both designed to provide guidance of the firing hooks on the bolts towards the center point or medial location of the elastic band for an even faster alignment of the bolt hook into the proper firing hook location or "sweet spot" to increase accuracy and distance by providing the proper proportional launching alignment between the upper launching band portion 110 and the lower launching band portion 112.

While the present band embodiments are provided, other bands can easily be conceived of and provided for providing the elasticity and spring launching force 54 required to meet the user's desired launching and distance requirements.

Figure 4:
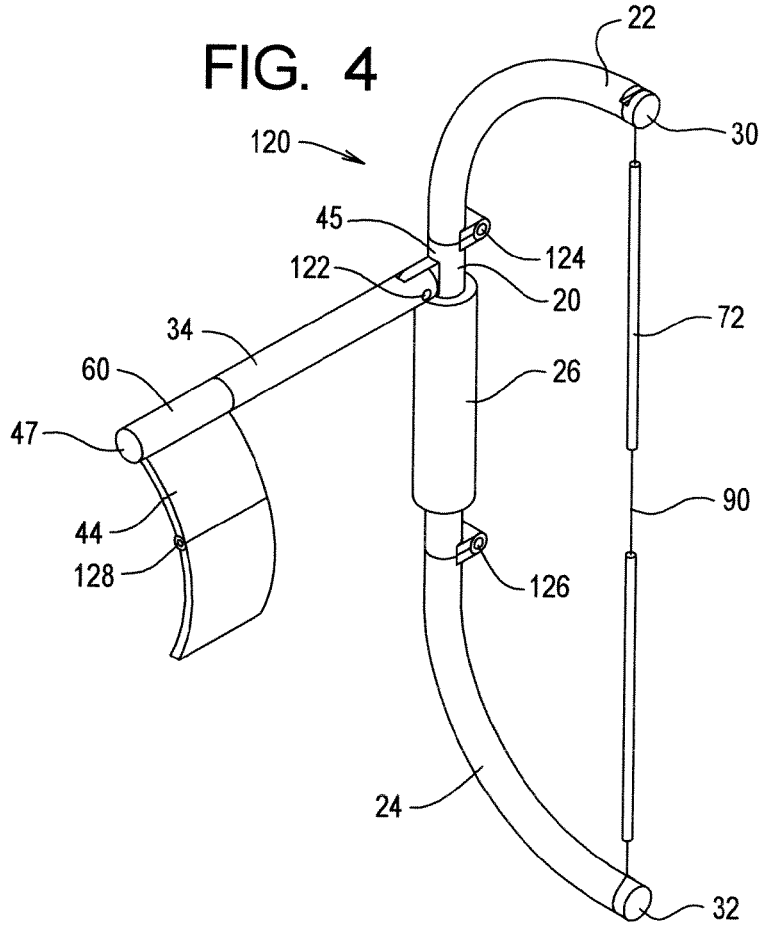
FIG. 4 is an alternative embodiment of the launching apparatus.

Many times the user will be traveling, and require a unit to be collapsible and compact. Referring to FIG. 4, an alternative embodiment is provided which is configured to collapse into a compact traveling type design and can then easily be erected into the launching apparatus for use at the various sporting events, hunting or as also conceived, for use as a child's toy.

Also, the forearm 34 is provided in an alternative embodiment as a single laterally aligned forearm member 60 having a forearm seat 44 cantilevering from the distal end 47 of the upper laterally aligned forearm member 60 in this embodiment. The forearm seat 44 is also provided in collapsible type arrangement so the seat and arm can be compacted with the rest of the apparatus. This particular embodiment includes a seat hinge 128 aligned laterally and parallel with the upper forearm member 60.

The collapsible launching apparatus arms including the transverse upper section 22 and the transversely aligned lower section 24 fold over the longitudinal medial section 20 and the gripping portion 26 by pivoting about their respective hinges, including the upper frame hinge 124, and the lower frame hinge 126. The forearm 34 folds against the grip 26 by the release of the longitudinal medial forearm hinge 122, attached to the longitudinal medial connection end 45 of the forearm 34 at the upper location of the longitudinal medial section 20.

Because the three-part band 72, in this particular embodiment, has essentially no compressive capacity, after the launching apparatus 120 is collapsed, the band can be wrapped around the collapsed unit and stored for later use.

Figure 5:
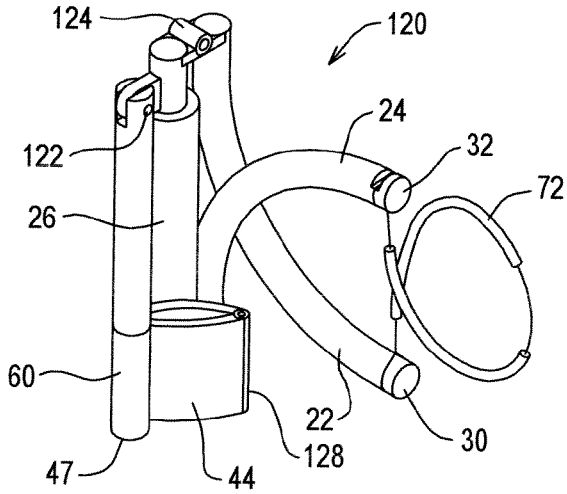
FIG. 5 is an alternative embodiment of the launching apparatus in a collapsed position.

Referring to FIG. 5, a discussion of the collapsible launching apparatus 120 will now be provided. While the present embodiment of the collapsible launching apparatus 120 has the transversely aligned upper section 22 and the transversely aligned lower section 24 folding about the longitudinal axis along the grip portion 26, other types of folding arrangements can be utilized and are readily conceived of. For example, folding the entire launching apparatus 120 about a hinge located at the midpoint (not shown) of the longitudinal medial portion or section 120. Nonetheless, in this particular embodiment, the collapsible launching apparatus 120 is arranged so that the transversely aligned upper section 22 and the transversely aligned lower section 24 can be folded along the longitudinal axis and against the grip portion 26. The transversely aligned upper section 22 folds against the grip portion 26 by folding or articulating about the upper frame hinge 124. Similarly, the transversely aligned lower section 24 folds and/or articulates about the lower frame hinge 126 against the longitudinally aligned medial section 20. The forearm 34 collapses in towards the longitudinal section 20 and aligns itself with the main portion of the medial section 20 or in other words the grip portion 26, and articulates about a laterally aligned seat hinge 128. After collapsing the launching apparatus 120 to its collapsed position, the launching apparatus can be stored in a traveling case for shipping.

Discussion will now be provided on the second portion of the overall assembly, the configuration of the bolt for rapid-fire launch. The bolts themselves are configured so that they can be rapidly launched from the elastic launching band 28 while being maintained in between the user's finger digits.

Figure 10:
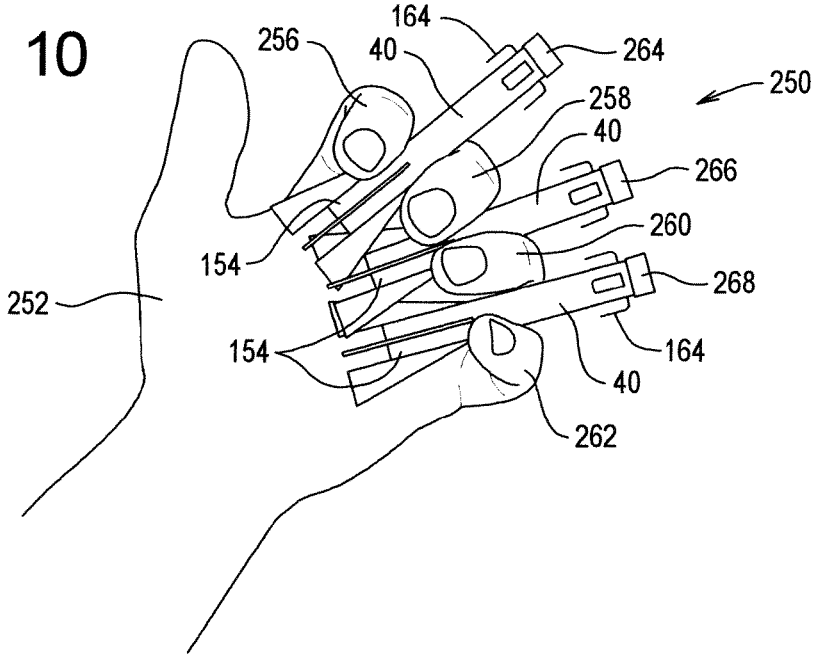
FIG. 10 is a perspective view of a user holding the bolts in a rapid-fire arrangement.

Referring first to FIG. 10, the bolts are held in a user's hand 252 and can be placed between the user's fingers for rapid fire bolt launching 250. One particular embodiment allows the bolts 40 to be arranged so that they can be easily drawn in succession against the elastic band 28 (FIG. 1).

For example, a first bolt 264 can be held between the index finger 256 of the user and the middle finger 258 of the user. A second bolt 266 can be held between the middle finger 258 of the user and the ring finger 260 of the user. Lastly a third bolt 268 can be held between the ring finger 260 of the user and the small finger 262 of the user. The bolts themselves can thus be held between these user fingers and the user can draw the first bolt 264 against the elastic launching band 28 as seen in FIG. 1, and apply the launching force 54 as seen in FIG. 2, to launch the first bolt.

Immediately after the first bolt has been launched, the user can align the second bolt 266 while it is still maintained between the middle finger and the ring finger in its current position, and launch the second bolt 266 by aligning the bolt firing hook to be discussed below, with the elastic bands 28, and applying a backwards or launching force 54 (FIG. 2) against the elastic launching band 28.

Lastly the user after firing the first bolt 264 and the second bolt 266 will still have the third bolt 268 maintained between the ring finger 260 and the small finger 262. The user can align and attach the third bolt 268, which will be discussed below, against the elastic band 28 (FIG. 1), and apply the launching force 54 (FIG. 2) to shoot the third successive bolt.

Referring now to and FIGS. 6-9, a detailed discussion of the bolt construction and alternative embodiments will be provided.

Figure 6:
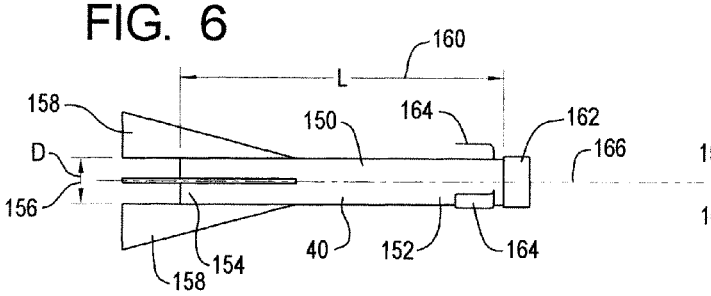
FIG. 6 is an elevational view of the bolt.

In the present embodiment, the bolt 40 as seen in FIG. 6, is currently provided as a cylindrical shaft, with a fore end 152 located at the front end in which the direction of the bolt will be fired, and an aft end 154 which is located at the rear of the cylindrically aligned lined shaft. The cylindrical aligned shaft 150 is arranged about shaft axis 166.

At the aft end 154 of the bolt 40, are positioned a number of fins 158 which provide for aerodynamic alignment of the bolt during the flight and also provide for a measure of grip between the user's fingers during the launching of the bolt.

Figure 7:
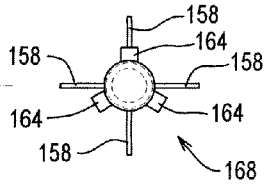
FIG. 7 is an elevational front view of the bolt.

In the particular embodiment being discussed, as seen in FIG. 6, the bolts currently have four fins 158 which are extending radially from the shaft axis 166 and the fins 158 are spaced circumferentially equidistant apart from one another about the cylindrical shaft, as can be seen in FIG. 7, the four fin, three hook arrangement 168.

Figure 8:
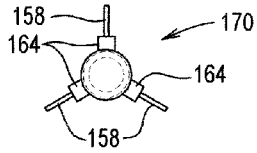
FIG. 8 is an alternative embodiment elevational front view of the bolt.

Alternatively, the bolts can have a three-fin arrangement and three-hook arrangement 170, as seen in FIG. 8, where in this particular embodiment the fins 158 are arranged in radial alignment with the hooks themselves 164, thus providing for a more uniform construction process.

Back to the first embodiment, as seen FIGS. 6-7, the fore end 152 has a number of firing hooks 164 which extend radially outwards from the shaft axis 166 and have an equidistant spacing about the shaft axis where the firing hooks 164 are arranged to face towards the aft portion of the bolt 40 which face towards the aft portion of the bolt 40. While the present embodiment is provided with three radially extending and aft facing firing hooks 164, a number of other firing hooks can be provided. For example, two firing hooks, one firing hook, four firing hooks, five firing hooks, or whichever number of firing hooks are adequate to provide for a reasonable measure of certainty to adequately catch the elastic launching band 28 (FIG. 1) at the intermediate catch location 42 as seen in FIG. 1. The firing hooks similar to the fins 158 are spaced circumferentially equidistant from one another about the cylindrical shaft 150. One way of connecting the firing hooks to the cylindrical shaft 150 is through the use of a connecting ring which has a slightly smaller diameter than the outer diameter of the cylindrical shaft 156. The shaft outer diameter 156 ranges from a maximum of approximately 1½ inches to at least a minimum of approximately ⅛ inch.

Along the same lines, the shaft length 160 ranges from approximately a maximum of 6 inches in length to a minimum of approximately 1 inch in length depending on the desired use and configuration of the bolt 40 for its particular sporting events. Along these lines, the bolts can be used for various types of sporting events including hunting, target practice, children's toys, as well as other types of uses such as for use within a movie as a prop.

With these various uses in mind, a brief discussion of the materials will be provided for the particular bolt configurations and/or uses. The bolt can be constructed of, for example, foam plastic which would lend itself towards a toy-like design. This toy-like design would be along the same lines of Nerf™-type toys where the primary user would be a child and/or young adult. The bolts themselves would have firing hooks which extend as previously mentioned radially from the fore end of the bolt head, and the firing hooks would have a yield which would enable them to only maintain a certain launching force 54, and if the launching force exceeded the minimum yield of the firing hook, then the firing hook would bend and break thus acting as a safety measure and preventing the firing hooks from being launched at a higher velocity and higher force rate.

Along these lines of the children's toys, the bolts can be constructed of puffed rice or other types of biodegradable materials such as pasta and/or a glutinous-type gelatin material which is more commonly referred to as seen in the Gummi Bear-type candy on the market.

In addition to the biodegradable type material as well as the toy plastic foam type material, other materials can be used to construct the bolts. These include wood type materials, metallic materials, PVC tubing type materials, fiberglass, or even a carbon fiber type construction. The above mentioned materials would be used more in the lines of hunting, sporting, and/or in the use of adult type sport designs.

Figure 9:
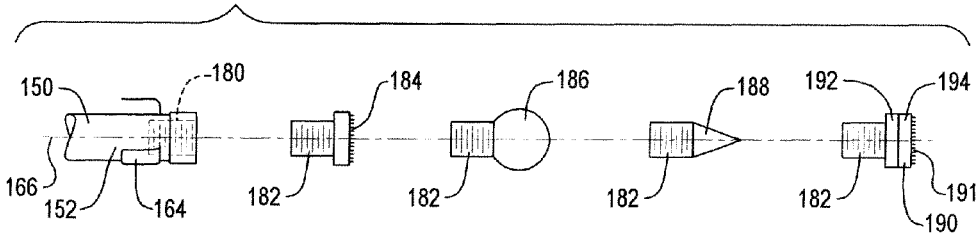
FIG. 9 is a detail elevational view of the bolt head embodiments.

To provide for the various types of uses that the bolts can be designed for, the bolt head 162, as seen in FIG. 9, is provided in an interchangeable type configuration for the various uses.

The bolt head 162 located at the extreme forward most end of the cylindrical shaft 150 can be either a permanent type connection to the cylindrical shaft 150 or can be a removable type of construction.

As seen in FIG. 6, the bolt head 162 is a shortened cylindrical shaft-type arrangement, having a larger diameter than the cylindrical shaft 150 of the bolt itself. The bolt head is also provided in different arrangements and different connection type configurations to attach to the shaft 150. As seen in FIG. 9, the cylindrical shaft 150 at the fore end 152 has a threaded receiver portion 180 with an inside volume of the cylindrical shaft 150 having threaded grooves in the shaft itself to accept a threaded head 182. At the fore end of the threaded head 182 is a Velcro™ head 184 which is configured in a cylindrical shape and has Velcro™ on the top front surface of the head. In this particular embodiment the attachment means is the hook portion of the "hook and loop"-type connector system generally referred to as Velcro™.

In addition to the cylindrical head, a spherical sponge type head 186 is shown attached to the threaded head portion 182. In the sponge foam head type configuration, the spherical sponges can be soaked with a marker-type liquid paint, and the bolt 40 can be fired at opposing individuals and the paint soaked into the sponge head 186 will then splatter on the person which is hit or the target, thus indicating a strike or a direct hit. Next, the bolt head 162 can be provided as a conical arrow-type shape 188 connected to the top portion of the threaded head 182. The conical arrow-type shape can be constructed of a metallic alloy or wood type of material and can be used for either hunting or sport target practice.

Figure 11:
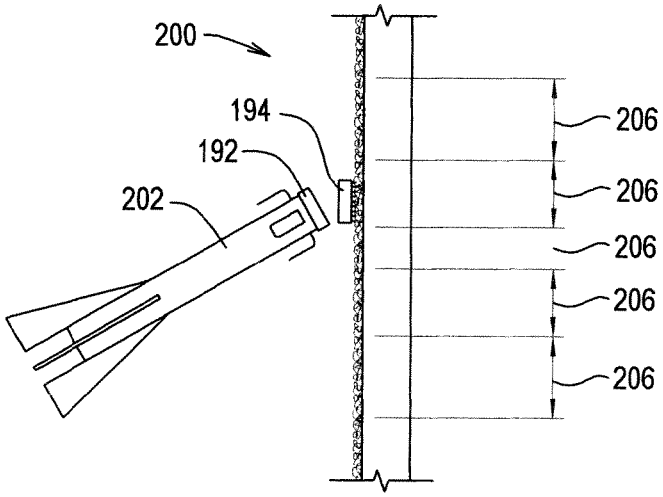
FIG. 11 is a detail elevational view of a bolt target assembly.

In addition to the previously mentioned head embodiments, a magnetic detachable head marker 190 is provided to be attached to the threaded head portion 182. At the outer surface of the detachable head marker 190, a hook-type fastener 191 for interface with the loop-type fastener, say for example, on a target as seen in FIG. 11. When the bolt 40 is shot from the launching apparatus 10, the bolt head 162 can impact a target 204, where the negative magnetic head 194 may adhere to the receiving portion of the Velcro™ type connection apparatus, and the positive magnetic head portion 192, which is permanently attached to the target bolt 202, due to the bolt dead load, will pull away from the negative bolt portion 202. The magnetic head portion 194 adhering to the particular circular scoring zone 206 of the target 204 as seen for target practice of the dart/bolt 202 to in the bolt target assembly 200 will indicate a score.

Figure 12:
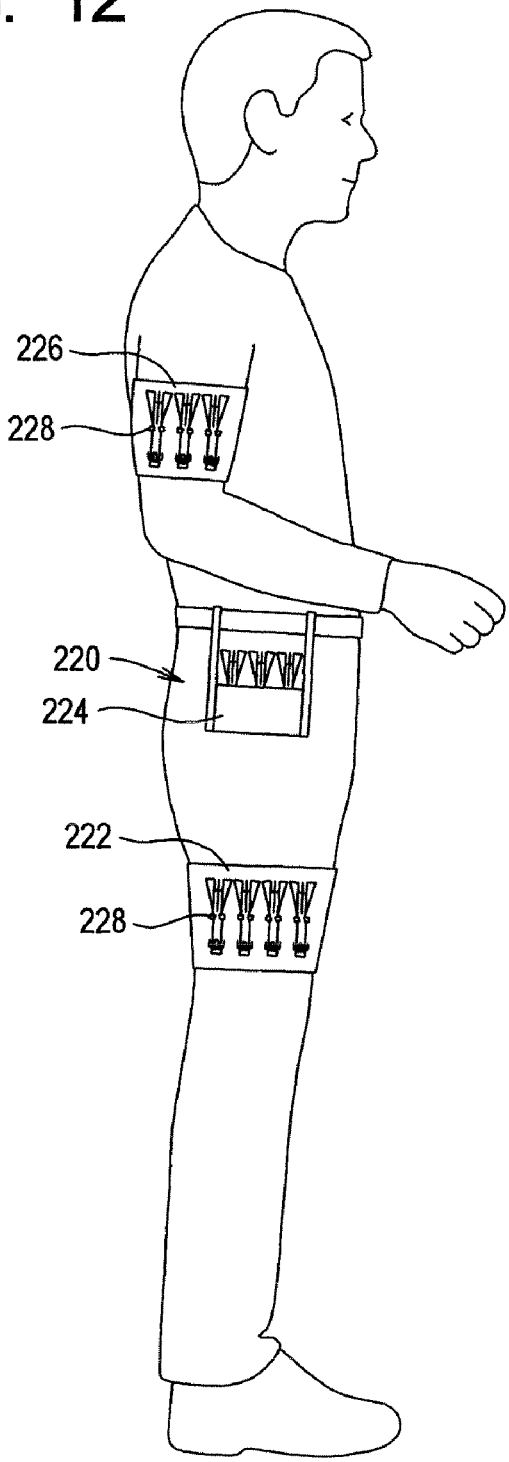
FIG. 12 is an elevational view of the bolt assemblies on user appendages.

Due to the rapid-fire nature of this entire assembly, multiple bolts must be readily accessible for use during a shooting match through the use of a bolt holster or bolt assembly apparatus 220, as seen in FIG. 12. The bolt assembly 220 provides the user with different embodiments or arrangements for carrying the bolts 40 on various appendages and/or about the waist of the user. For example, an arm bolt assembly 226 is provided where the bolts 40 are attached to an armband which in one form might be spandex type material, in another form might be a cloth with a Velcro™ type fastener, and the bolts are attached to the armband through the use of bolt holders or bolt clips 228. This bolt clip can be a clip type double arm fastener arrangement or they can be a connector type arrangement where the bolt itself has a Velcro™ hook fastener and the band has a Velcro™ loop fastener so that the bolts can be attached. Furthermore, the connector portion is also designed to be provided by a plurality of loops which might be attached to the outer face of the armband. Similar to the armband, a leg band assembly 222 can be provided for additional storage of the plurality of bolts 40. Lastly, a belt bolt assembly 224 is provided where the bolts sit within a pocket of the belt bolt pouch and the pouch itself is connected to the belt of the user through the use of loop-type connectors.

I claim:

1. A rapid fire launching apparatus comprising:

a. an arcuate frame comprising a longitudinal medial section, a transversely aligned upper section, and a transversely aligned lower section;

b. said longitudinal medial section further comprising a grip portion substantially bisecting said longitudinal medial section;

c. said arcuate frame further comprising an elastic launching band held taut between an upper connector extending from said transversely aligned upper section and a lower connector extending from said transversely aligned lower section;

d. said longitudinal medial section further comprising a forearm brace extending parallel to a forearm central axis of a user, said forearm brace configured to maintain a launching plane between said arcuate frame and said user's forearm by resisting a moment about said longitudinal medial section of said arcuate frame due to an elastic band launching force exercised on said arcuate frame during rapid fire launch; of a bolt from said elastic band;

e. said bolt comprising: a longitudinally aligned cylindrical shaft having a fore-end and an aft-end; said fore-end further comprising a head portion at the forward most portion of said fore-end, a first firing hook extending radially and facing aft, a second firing hook extending radially and facing aft, said first firing hook and said second firing hook spaced circumferentially equidistant from each other about said cylindrical shaft and positioned to facilitate rapid fire of said bolt from said elastic band;

f. said aft-end of said bolt further comprising a first fin radially extending from said cylindrical shaft, a second fin radially extending from said cylindrical shaft, a third fin radially extending from said cylindrical shaft, said first fin, second fin and third fin each spaced circumferentially equidistant apart from the other about said cylindrical shaft, said fins configured to provide aero-dynamic alignment during flight and grip for user's fingers during launch;

g. said elastic band further comprises an upper elastic band portion, a lower elastic band portion and an intermediate catch portion arranged between said upper elastic band portion and said lower elastic band portion, said intermediate catch portion substantially non-elastic.

2. A rapid fire launching apparatus comprising:

a. an arcuate frame comprising a longitudinal medial section, a transversely aligned upper section, and a transversely aligned lower section;

b. said longitudinal medial section further comprising a grip portion substantially bisecting said longitudinal medial section;

c. said arcuate frame further comprising an elastic launching band held taut between an upper connector extending from said transversely aligned upper section and a lower connector extending from said transversely aligned lower section;

d. said longitudinal medial section further comprising a forearm brace extending parallel to a forearm central axis of a user, said forearm brace configured to maintain a launching plane between said arcuate frame and said user's forearm by resisting a moment about said longitudinal medial section of said arcuate frame due to an elastic band launching force exercised on said arcuate frame during rapid fire launch; of a bolt from said elastic band;

e. said bolt comprising: a longitudinally aligned cylindrical shaft having a fore-end and an aft-end; said fore-end further comprising a head portion at the forward most portion of said fore-end, a first firing hook extending radially and facing aft, a second firing hook extending radially and facing aft, said first firing hook and said second firing hook spaced circumferentially equidistant from each other about said cylindrical shaft and positioned to facilitate rapid fire of said bolt from said elastic band;

f. said aft-end of said bolt further comprising a first fin radially extending from said cylindrical shaft, a second fin radially extending from said cylindrical shaft, a third fin radially extending from said cylindrical shaft, said first fin, second fin and third fin each spaced circumferentially equidistant apart from the other about said cylindrical shaft, said fins configured to provide aero-dynamic alignment during flight and grip for user's fingers during launch;

g. said forearm brace further comprises a first upper laterally aligned member, a second lower laterally aligned member, said upper laterally aligned member connected rigidly to a top end of said gripping portion, said second lower laterally aligned member connected rigidly to a bottom end of said gripping portion at the longitudinally aligned lower location, a semicircular forearm seat connecting said first upper laterally aligned member to said second lower laterally aligned member, said semicircular forearm seat configured to provide leverage stability against said forearm by resisting said launching moment arm about said longitudinal medial section due to said maximum elastic band force.

3. The rapid fire launching apparatus according to claim 2 wherein said arcuate frame further comprises: a plastic material, a metallic material, a carbon fiber material, or a wooden material.

4. The rapid fire launching apparatus according to claim 2 wherein said forearm brace further comprises a plastic material, wooden material, metallic material, a carbon fiber material.

5. The rapid fire launching apparatus according to claim 2 wherein said bolt further comprises a third firing hook extending radially and facing aft, said first firing hook, said second firing hook, and said third firing hook circumferentially spaced equidistant from one another about said cylindrical shaft.

6. The rapid fire launching apparatus according to claim 2 wherein said bolt further comprises a fourth fin radially extending from said cylindrical shaft, said first fin, said second fin, said third fin, and said fourth fin spaced circumferentially equidistant apart from each other about said cylindrical shaft.

7. The rapid fire launching apparatus according to claim 2 wherein said bolt further comprises a foam/plastic material for child safe toys.

8. The rapid fire launching apparatus according to claim 2 wherein said bolt further comprises one or more of the following materials: wood, metal, PVC, fiberglass, carbon fiber.

9. The rapid fire launching apparatus according to claim 2 wherein said bolt further comprises a longitudinally aligned length of about 6 inches or less.

10. The rapid fire launching apparatus according to claim 2 wherein said head portion is further configured to be removed from said fore end and replaced with a replacement head.

11. The rapid fire launching apparatus according to claim 2 wherein said head portion further comprises a target locking mechanism for attachment to a surface of a target, upon impact of said target locking mechanism against said target surface.

12. The rapid fire launching apparatus according to claim 11 wherein said target locking mechanism comprises either a hook or a loop type fastener to engage with said target surface comprising either a hook or a loop type receiver for attachment with said target locking mechanism.

13. The rapid fire launching apparatus according to claim 11 wherein said bolt head is further comprised to detach from said fore end upon impact of said target surface.

14. The rapid fire launching apparatus according to claim 2 wherein said cylindrical shaft further comprises a shaft diameter of about 1½ inches or less.

15. The rapid fire launching apparatus according to claim 2, wherein said apparatus further comprises: a bolt holster comprising a plurality of quick release bolt holders, said quick release bolt holders configured to maintain a plurality of bolts on said bolt holster and allow a user to easily grab said bolt and detach said bolt from said bolt holster.

16. The rapid fire launching apparatus according to claim 2 wherein said elastic launching band further comprises a bolt catch location configured to accept a bolt for rapid-fire launch.

17. The rapid fire launching apparatus according to claim 2 wherein said elastic band further comprises a surgical tubing material.

18. A rapid fire launching apparatus comprising:

a. an arcuate frame comprising a longitudinal medial section, a transversely aligned upper section, and a transversely aligned lower section;

b. said longitudinal medial section further comprising a grip portion substantially bisecting said longitudinal medial section;

c. said arcuate frame further comprising an elastic launching band held taut between an upper connector extending from said transversely aligned upper section and a lower connector extending from said transversely aligned lower d. said longitudinal medial section further comprising a forearm brace extending parallel to a forearm central axis of a user, said forearm brace configured to maintain a launching plane between said arcuate frame and said user's forearm by resisting a moment about said longitudinal medial section of said arcuate frame due to an elastic band launching force exercised on said arcuate frame during rapid fire launch; of a bolt from said elastic band;

e. said bolt comprising: a longitudinally aligned cylindrical shaft having a fore-end and an aft-end; said fore-end further comprising a head portion at the forward most portion of said fore-end, a first firing hook extending radially and facing aft, a second firing hook extending radially and facing aft, said first firing hook and said second firing hook spaced circumferentially equidistant from each other about said cylindrical shaft and positioned to facilitate rapid fire of said bolt from said elastic band;

f. said aft-end of said bolt further comprising a first fin radially extending from said cylindrical shaft, a second fin radially extending from said cylindrical shaft, a third fin radially extending from said cylindrical shaft, said first fin, second fin and third fin each spaced circumferentially equidistant apart from the other about said cylindrical shaft, said fins configured to provide aero-dynamic alignment during flight and grip for user's fingers during launch;

g. said forearm brace further comprises a first upper laterally aligned member rigidly connected to said longitudinal medial section near said gripping location, said first upper laterally aligned member extending parallel to said forearm central axis, said laterally aligned member having a longitudinal medial connection end and a distal end, a semicircular forearm seat extending from said distal end of said laterally aligned member to provide leverage stability against said forearm by resisting said launching moment arm about said longitudinal medial section due to said maximum elastic band force.

19. A rapid fire launching apparatus comprising:

a. an arcuate frame comprising a longitudinal medial section, a transversely aligned upper section, and a transversely aligned lower section;

b. said longitudinal medial section further comprising a grip portion substantially bisecting said longitudinal medial section;

c. said arcuate frame further comprising an elastic launching band held taut between an upper connector extending from said transversely aligned upper section and a lower connector extending from said transversely aligned lower section;

d. said longitudinal medial section further comprising a forearm brace extending parallel to a forearm central axis of a user, said forearm brace configured to maintain a launching plane between said arcuate frame and said user's forearm by resisting a moment about said longitudinal medial section of said arcuate frame due to an elastic band launching force exercised on said arcuate frame during rapid fire launch; of a bolt from said elastic band;

e. said bolt comprising: a longitudinally aligned cylindrical shaft having a fore-end and an aft-end; said fore-end further comprising a head portion at the forward most portion of said fore-end, a first firing hook extending radially and facing aft, a second firing hook extending radially and facing aft, said first firing hook and said second firing hook spaced circumferentially equidistant from each other about said cylindrical shaft and positioned to facilitate rapid fire of said bolt from said elastic band;

f. said aft-end of said bolt further comprising a first fin radially extending from said cylindrical shaft, a second fin radially extending from said cylindrical shaft, a third fin radially extending from said cylindrical shaft, said first fin, second fin and third fin each spaced circumferentially equidistant apart from the other about said cylindrical shaft, said fins configured to provide aero-dynamic alignment during flight and grip for user's fingers during launch;

g. said bolt further comprising an edible material comprising one or more of the following ingredients: puffed rice, pasta, glucose and gelatin.

* * * * *